United States Patent [19]

Kallman

[11] Patent Number: 4,933,992

[45] Date of Patent: Jun. 19, 1990

[54] MITTEN ATTACHMENT WITH A THUMB PORTION FOR A GLOVE WITH AN APPENDAGE STOWAGE SYSTEM

[76] Inventor: Robert A. Kallman, 14 Passaic Ave. - Apt. 3B, Nutley, N.J. 07110

[21] Appl. No.: 286,757

[22] Filed: Dec. 19, 1988

Related U.S. Application Data

[63] Continuation-in-part of Ser. No. 166,179, Mar. 10, 1988.

[51] Int. Cl.[5] ..... A41D 19/01

[52] U.S. Cl. ..... 2/160; 2/158; 2/161 R; 2/161 A

[58] Field of Search ..... 2/159, 160, 161 R, 161 A

[56] References Cited

U.S. PATENT DOCUMENTS

| | | | |
|---|---|---|---|
| 961,149 | 6/1910 | Maynard | 2/158 |
| 993,662 | 5/1911 | Dueease | 2/158 |
| 1,216,877 | 2/1917 | Stewart | 2/158 |
| 1,275,837 | 8/1918 | Biggs | 2/158 |
| 1,286,771 | 12/1918 | Raymond | 2/158 |
| 1,413,967 | 4/1922 | Clark | 2/158 |
| 1,786,227 | 12/1930 | Bruggeman | 2/158 |
| 2,128,796 | 8/1938 | Böhm-Myro | 2/158 |
| 2,274,335 | 2/1942 | Kennedy | 2/158 |
| 2,451,837 | 10/1948 | Londe et al. | 2/158 |
| 2,603,790 | 7/1952 | Boehm-Myro | 2/158 |
| 3,064,266 | 11/1962 | Veghte, Jr. | 2/158 |
| 3,299,441 | 1/1967 | Slimovitz | 2/158 |
| 3,403,408 | 10/1968 | Helfer | 2/158 |
| 4,651,350 | 3/1987 | Dawiedczyk | 2/158 |

FOREIGN PATENT DOCUMENTS 521236 7/1953 Belgium .

335837 10/1930 United Kingdom .

*Primary Examiner*—Werner H. Schroeder
*Assistant Examiner*—Jeanette E. Chapman
*Attorney, Agent, or Firm*—Edwin D. Schindler

[57] ABSTRACT

The present invention provides a mitten attachment for use in combination with a glove, which may also be detachably attached, or permanently attached, to the glove, and which includes a stowage system to permit a wearer of the glove to safely and conveniently secure conventional pocket items, such as money or household or car keys. The mitten attachment of the invention is, preferably, secured to the wearer's hand, over a glove already being worn by the wearer, via a series of strap portions which preferably secure the mitten attachment by having one strap portion encircle the wrist area of the user and another strap portion encircling the palm area of the user. The mitten attachment also, preferably, includes a thumb attachment portion for the optional enclosure of the gloved thumb of the user. Each strap portion is preferably integral with the overall construction of the mitten attachment. Additional, or fewer, strap portions may be utilized with the present invention. Alternatively, the article of the present invention may be either permanently secured to the glove of the wearer or fully or partially detachably attached by means, for example, of Velcro. The mitten portion of the mitten attachment article may be utilized to hold conventional pocket items, such as money or keys. Such items may be placed within the mitten portion of the article and the mitten portion may then be folded back underneath the backside portion of the article to securely stow such article. Various other embodiments of the present invention are also disclosed.

45 Claims, 9 Drawing Sheets

Fig. 13.
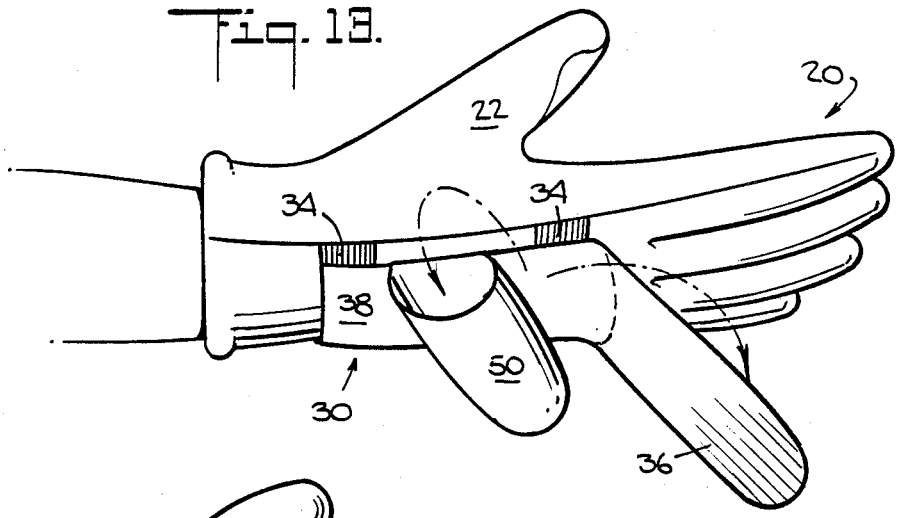
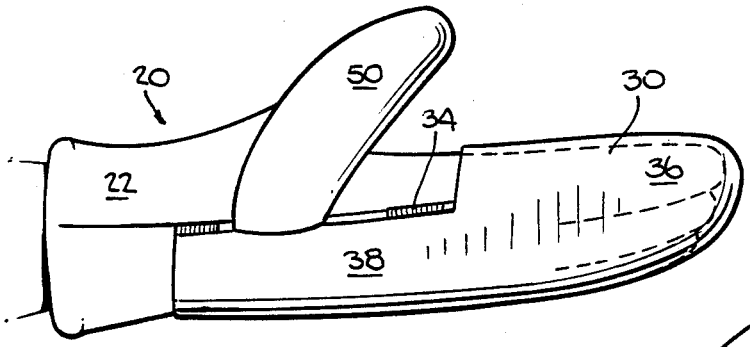
Fig. 14.
Fig. 15.
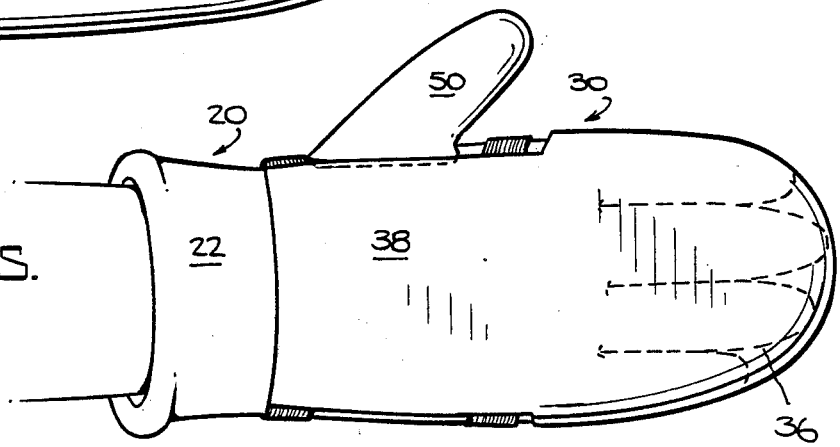
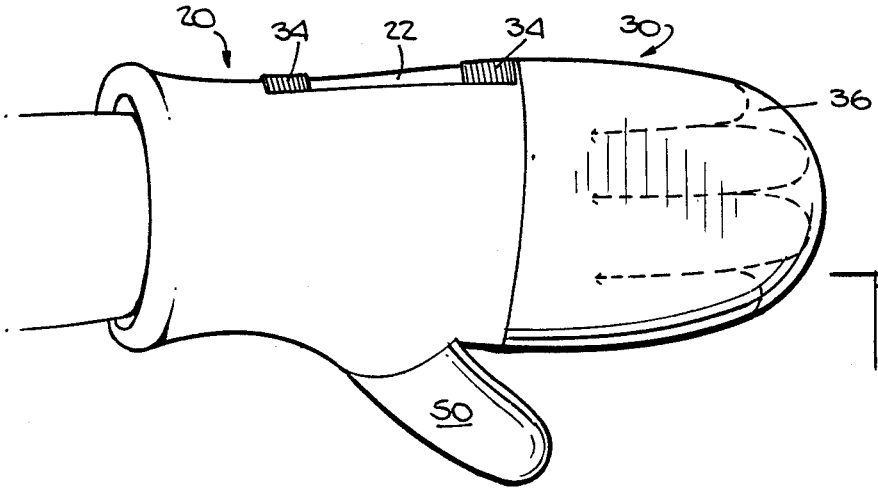
Fig. 16.

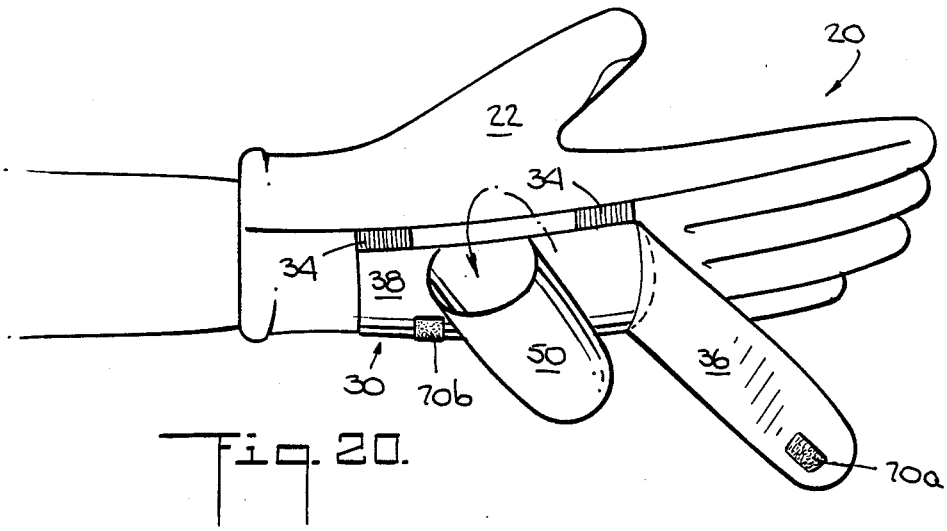
Fig. 20.
Fig. 21.
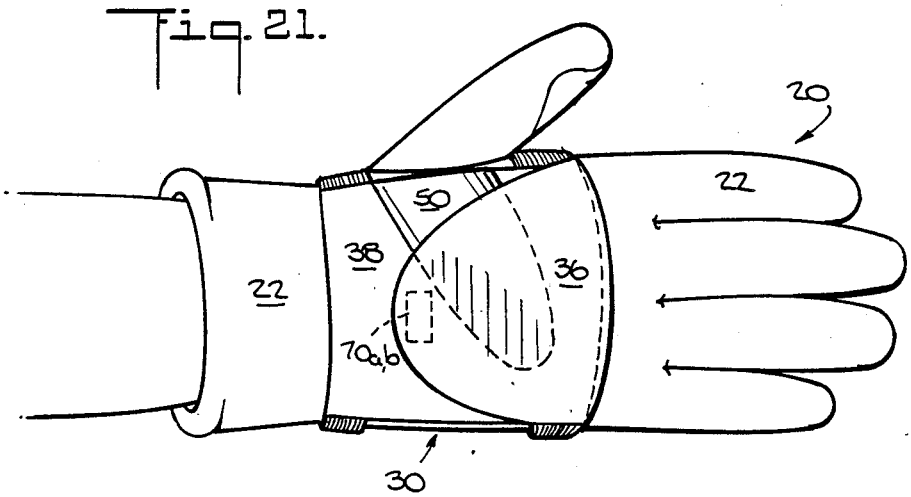

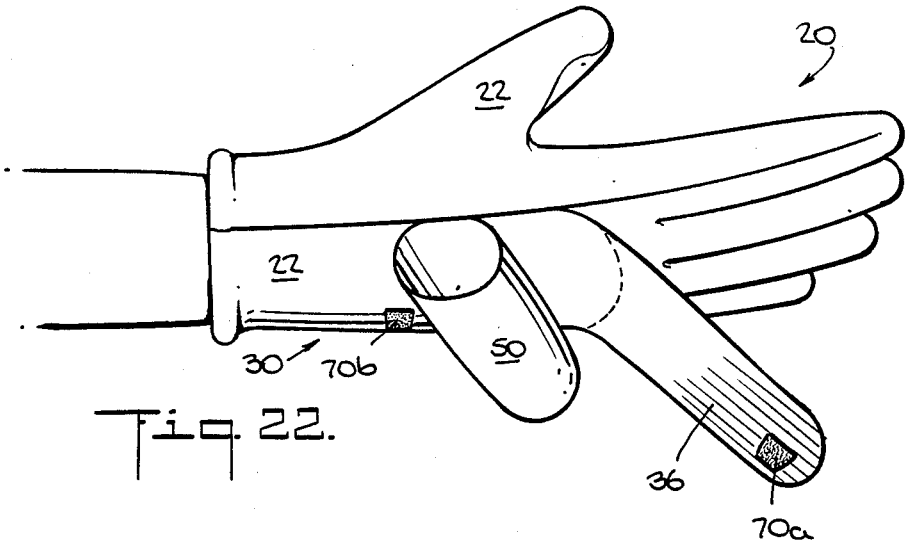
Fig. 22.
Fig. 23.
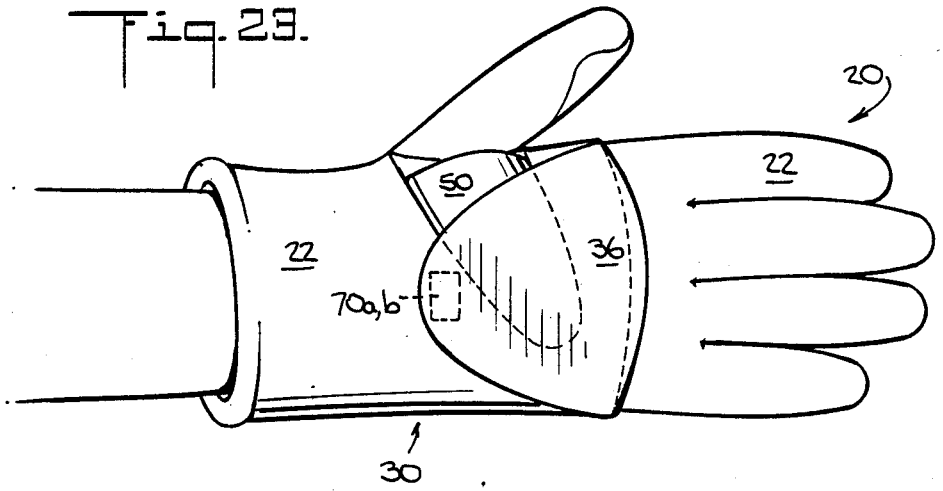

MITTEN ATTACHMENT WITH A THUMB PORTION FOR A GLOVE WITH AN APPENDAGE STOWAGE SYSTEM

CROSS-REFERENCE TO PRIOR APPLICATION

This application is a continuation-in-part of application Ser. No. 166,179, filed Mar. 10, 1988.

BACKGROUND OF THE INVENTION

1. Technical Field of the Invention

The present invention relates to a mitten attachment for a glove in which the mitten attachment includes a stowage system. More particularly, the present invention relates to a mitten attachment which is capable of being attached to a conventional glove for use in combination with the mitten attachment. The mitten attachment is constructed so that, in addition to providing greater warmth and comfort to the hands and, particularly, the fingers of the wearer, the attachment is also capable of being used as a means of stowage, for the wearer of the glove, for such items as pocket money and keys. As will be explained in greater detail hereinafter, the mitten attachment of the present invention may further include an optional attachment for placement over the thumb of a user's gloved hand.

In addition, the attachment of the present invention, while preferably employed as a mitten attachment, wherein the four gloved fingers of the user (i.e., excluding the thumb of the user) are preferably contained within a fingerless pocket, or mitten portion, may, alternatively, be contained in an attachment having separate portions for each finger of the user, in addition to a further possible attachment for the user's gloved thumb.

The present invention further includes having a mitten attachment and a thumb portion attached to the backside of a glove wherein the thumb portion, when not enclosing the gloved thumb of the user, may be folded back, against the backside of the glove, whereafter the mitten portion, which is also attached to the glove of the wearer, may be folded backward and secured to the backside of the glove of the wearer by securing means, such as Velcro, a clip, etc. The folded-back mitten portion would overlay the already folded-back thumb portion and secure this piece of the invention, as well.

Alternatively, the mitten portion of the invention may, initially, be folded backward. Thereafter, the thumb portion, which is preferably made of a flexible, stretchable material, may then be folded over the already folded-backward mitten portion and secured in such crossed-over position to hold in place the mitten portion. The thumb portion, in such an embodiment would have to be provided with means for securement to the glove. Such means for securement may include a Velcro attachment, a clip, a buckle attachment, etc. A Velcro attachment would be preferable, however.

The present invention, it should further be realized, may be utilized in combination with a fingered or unfingered glove.

2. Description of the Prior Art

Heretofore, there have been various attachable mitten pieces for use in combination with gloves, or such pieces which otherwise have formed appendages of gloves. Such mitten pieces, however, were not capable of both acting as an additional protector element for the hands and fingers of the wearer and also capable of being manipulated for use as a convenient and secure stowage system for pocket items such as loose money, household keys, etc. The prior art, thus far, fails to provide or otherwise suggest a neat and convenient stowage system for the mitten attachment for use in combination with a glove.

SUMMARY OF THE INVENTION

It is, therefore, an object of the present invention to provide a mitten attachment for use in combination with a glove, which provides an additional measure of warmth and comfort to the wearer's hands and fingers.

It is a further object of the invention to provide a mitten attachment for use in combination with a glove which may either be permanently attached to the glove or which is capable of quick and easy detachment.

It is, yet a further object of the present invention to provide a mitten attachment, for use in combination with a glove, which provides a convenient, neat, flat and comfortable stowage system of the mitten pocket portion of the attachment so that the pocket portion smoothly fits against the backside of the glove.

It is a further object of the present invention to provide a glove having, optionally, a thumb covering portion, which may be utilized at the option of the wearer of the glove attachment of the present invention.

It is an additional object of the present invention to a mitten attachment for a glove which is economical to manufacture.

The foregoing and related objects are achieved by the present invention which provides a mitten attachment for use in combination with a glove, which may also be detachably attached to the glove, and which includes a stowage system to permit a wearer of the glove to safely and conveniently secure conventional pocket items, such as money or household or car keys.

The mitten attachment of the invention is, preferably, secured to the wearer's hand, over a glove already being worn by the wearer, via a series of strap portions which preferably secure the mitten attachment by having one strap portion encircle the wrist area of the user and another strap portion encircling the palm area of the user. Each strap portion is preferably integral with the overall construction of the mitten attachment. Additional, or fewer, strap portions may be utilized with the present invention. One wide strap may be used wherein a thumb hole is provided.

In an alternative preferred embodiment of the invention, the mitten attachment of the present invention may further include a thumb portion, or attachment, which may, at the option of the wearer, be fitted over the gloved thumb of the user of the present invention.

In yet another embodiment of the present invention, the portion of the present invention which is designed to cover the wearer's four gloved fingers, i.e., excluding the thumb, may be made into separate compartments for each of the four fingers of the user of the attachment of the invention.

In yet a further embodiment of the present invention, a mitten attachment portion and a thumb portion are attached to the backside of a glove wherein the thumb portion, when not enclosing the gloved thumb of the user, may be folded back, against the backside of the glove. Thereafter, the mitten portion, which is also attached to the glove of the wearer, may be folded backward and secured to the backside of the glove of the wearer by securing means, such as Velcro, a clip, etc. The folded-back mitten portion would overlay the already folded-back thumb portion. The mitten and thumb attachments, in this embodiment of the present invention, may either be permanently attached or removably attached to the glove of the wearer.

Alternatively, the mitten portion of the invention may, initially, be folded backward. Thereafter, the thumb portion, which is preferably made of a flexible, stretchable material, may then be folded over the already folded-backward mitten portion and secured in such crossed-over position to hold in place the mitten portion.

Additionally, it should further be recognized that the present invention may be employed in combination with a fingered or unfingered glove; the latter type of glove having gained in popularity in recent years.

As part of the mitten attachment article of the invention, the article includes a backside portion which covers the backside of the user's hand, i.e., the side of the user's hand opposite the user's palm. It should, of course, be understood that the mitten attachment article of the invention fits over the glove already being worn by the user. Accordingly, the backside portion of the mitten attachment article necessarily also covers the backside of the glove. The strap portions of the article should preferably be integrally attached to the backside portions of the mitten attachment.

Finally, the mitten attachment article of the invention includes a mitten portion which is integrally attached to the backside portion of the article. More particularly, the mitten portion of the inventive article comprises a pocket portion which encloses the fingers of the user in a fashion analogous to the way that a conventional mitten would enclose one's fingers. (Alternatively, the pocket portion of the invention may be made into separate compartments for separately enclosing each of the fingers of the user.) The upper portion of the mitten portion of the invention, however, is integrally attached to the backside portion of the mitten attachment. The lower portion of the mitten portion of the article is unattached. The terms "upper portion" and "lower portion," with respect to the mitten portion of the article, refer to the segment of material of the mitten portion when the user is wearing the invention and the palms of the user's hands are facing downward toward a floor.

The mitten portion therefore forms a pocket for either the fingers of the user or for the placement of pocket change, keys, etc. When the mitten portion is used as a protective cover for the user's fingers, it is contemplated that the mitten portion of the invention will enclose the fingers of the user, which are separately enclosed, previously, in a glove. The mitten attachment of the present invention, of course, may be employed with a fingerless glove, in which case the mitten attachment of the invention would be the sole covering, or enclosure, for the fingers of the user.

When the mitten portion (preferably, without separate compartments or portions for each of the user's fingers) is contemplated for use as a pocket for conventional pocket items, keys, pocket change, etc., the same may be placed within the mitten portion of the inventive mitten attachment. The mitten portion is then folded smoothly under the backside portion of the invention and the contents of the mitten portion are securely and safely stowed while the wearer engages in other activity.

The mitten attachment article of the present invention may be made, preferably, of any relatively durable, flexible material. A preferred material for making the invention is neoprene.

Other objects and features of the present invention will be discussed and described in further detail hereinafter, with reference being made to the accompanying drawing figures. It should, however, be pointed out that the accompanying figures illustrate but one preferred embodiment of the invention and are not intended as a definition of the limitations of the invention or of the scope thereof.

BRIEF DESCRIPTION OF THE DRAWINGS

In the drawing, wherein similar reference numeral denote similar features throughout the several views:

FIG. 13 is a side view of the mitten attachment embodiment of FIG. 11 with a thumb attachment portion, the mitten portion and thumb attachment portion of the present invention being unfolded from the backside portion of the mitten attachment of the present invention;

FIG. 14 is a side view of the embodiment of FIG. 11, having a thumb attachment portion, wherein the thumb attachment portion covers the gloved thumb of the wearer, while the mitten portion of the invention covers the remaining four gloved fingers of the wearer;

FIG. 15 is an elevational view of the backside of a wearer's hand of the embodiment of FIG. 11 of the present invention, as worn by a wearer and as illustrated in FIG. 14;

FIG. 16 is an elevational view of the inside, or palm side of a wearer's hand of the embodiment of FIG. 11 of the present invention, as worn by a wearer and as illustrated in FIG. 14;

FIG. 20 is a side, prospective view of a further embodiment of the present invention, wherein the thumb and portions of the invention are folded backward against the outer side of the backside portion of the mitten attachment of the present invention in which the mitten portion includes means for securement to the outer side of said backside portion;

FIG. 21 is an elevational view of the embodiment of FIG. 20 following the initial folding backward against the backside portion of the mitten attachment, the thumb portion, subsequently followed by the folding backward, and securement, of the mitten portion of the backside portion of the invention, thereby also securing the thumb portion of the invention;

FIG. 22 is a side, prospective view of the embodiment of FIGS. 20 and 21, except that the mitten portion and the thumb portion of the invention are directly attached to the backside of the glove of the wearer, rather than secured by the mitten attachment/backside portion shown in FIGS. 20 and 21;

FIG. 23 is an elevational view of the embodiment of FIG. 22 following the initial folding backward directly against the backside portion of the glove of the wearer, the thumb portion, subsequently followed by the folding backward, and securement, of the mitten portion directly to the backside portion of the glove thereby also securing the thumb portion;

DETAILED DESCRIPTION OF THE DRAWING

Figure 1:
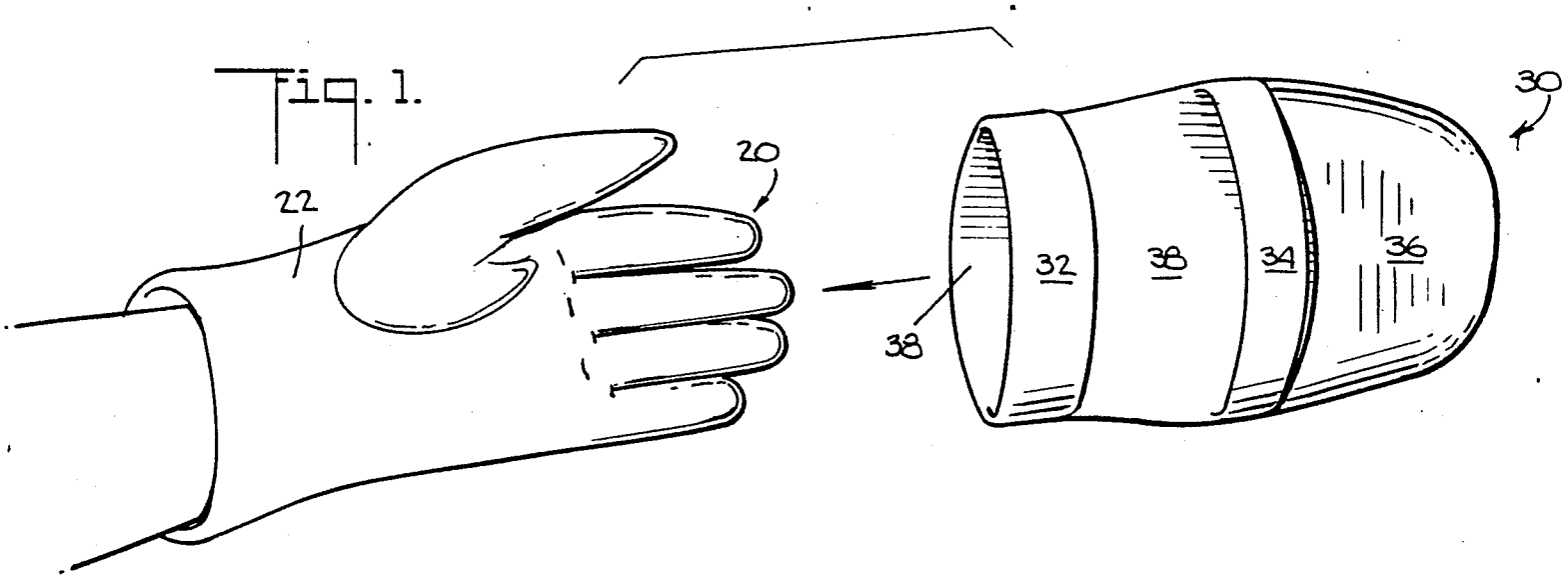
FIG. 1 is an elevational view showing the mitten attachment article of the present invention prior to securement to the gloved hand of a user.

Turning now, in detail, to the drawing, FIG. 1 is an elevational view of the gloved hand of a user 20 with glove 22 thereon. FIG. 1 also shows the mitten attachment article of the present invention, designated by the reference numeral 30. Attachment 30 includes strap portions 32, 34 and mitten portion 36. A portion of the inner side of backside portion 38 is also visible in FIG. 1. As indicated by the arrow in the figure, mitten attachment 30 is to be secured, i.e., detachably detached, over glove 22 of the user hand.

Figure 3:
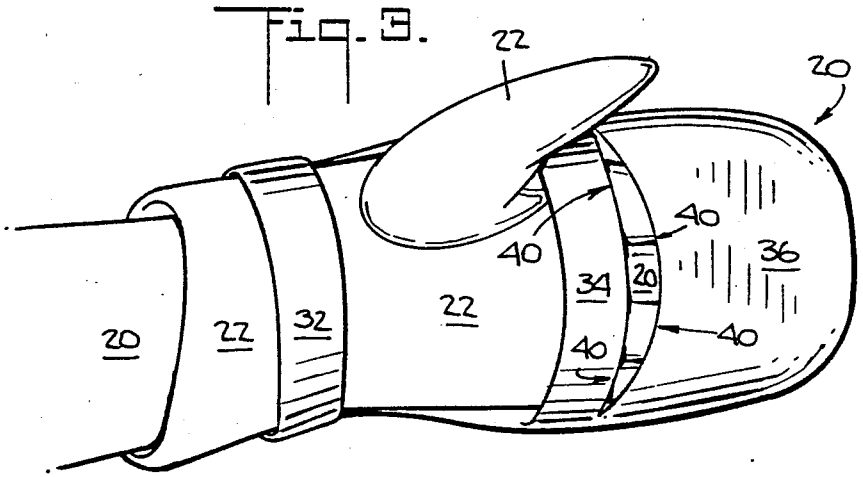
FIG. 3 is an elevational view of the mitten attachment article of the present invention secured to the gloved hand of a user with the mitten portion shown enclosing the user's fingers.
Figure 2:
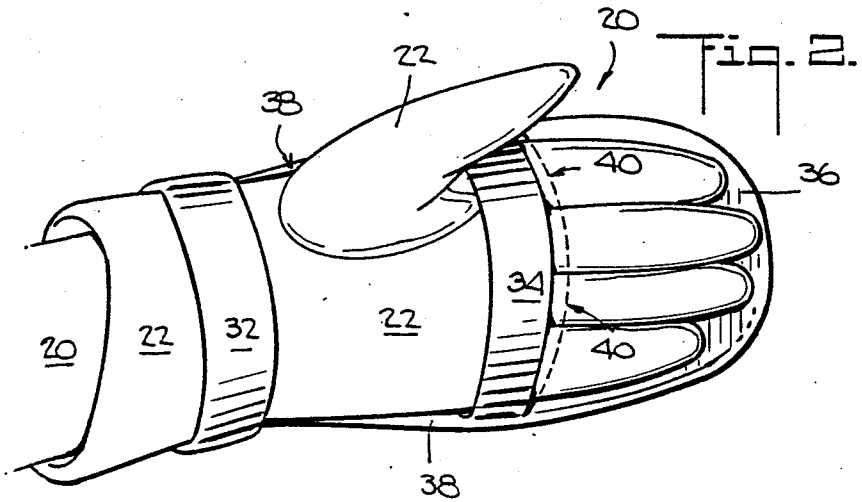
FIG. 2 is an elevational view of the mitten attachment article of the present invention secured to the gloved hand of a user, with the mitten portion of the article being drawn to show the gloved fingers of the user therein.

Mitten attachment 30 is secured, in one possible mode, over glove 22 in the manner shown in FIG. 2. In this mode, strap portion 32 encircles the lower part of a user's hand or wrist. Strap portion 34 wraps around the user's hand below the user's fingers and above the user's thumb. The preferred means by which strap portions 32 and 34 encircle the user's gloved hand is shown in FIGS. 2 and 3. In FIGS. 2 and 3, backside portion 38 of attachment 30 is secured against the outer side of the user's hand, i.e., the side opposite of the palm of the user's hand. In FIG. 2, mitten portion 36 is shown as not enclosing the fingers of the user and, instead, rests upon the back of the user's fingers. In FIG. 3, mitten portion 36 is shown as enclosing the user's fingers. In order to secure the mitten attachment to the gloved hand of a user, the user would first secure strap portions 32, 34 around his wrist and hand, as shown in FIG. 2, and then would deform, or otherwise pull, mitten portion 36 in a fashion in order to secure the user's fingers, as shown in FIG. 3.

In order that the user's fingers, contained in glove 22 and mitten portion 36, are sufficiently flexible, as well as to enable the user to readily secure the mitten attachment 30, strap portion 34 and mitten portion 36 should separated from one another by a slit, the outline of which is designated by the reference numeral 40.

The mitten attachment 30 should preferably be made so that all features of the article are integral with one another. Attachment 30 should be made out of a flexible material which is preferably resistant to water and is capable of providing additional warmth to the hands of the user. A preferred material for making the inventive attachment is neoprene.

Figure 4:
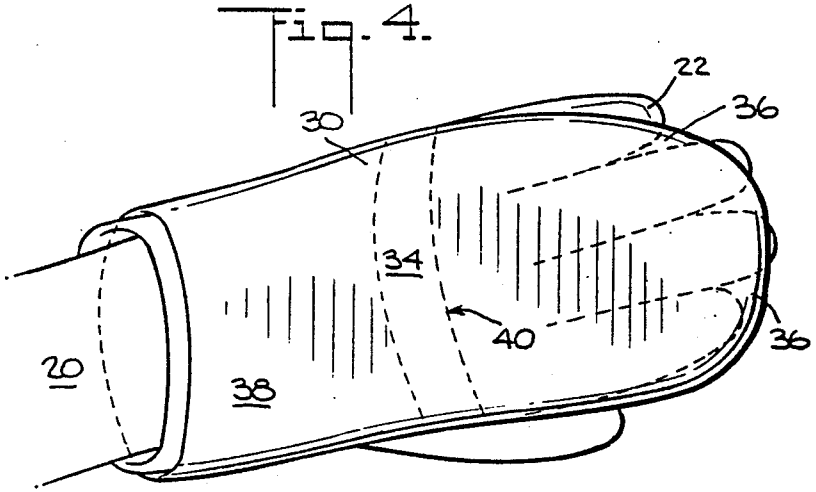
FIG. 4 is an elevational view of the mitten attachment article secured to the gloved hand of the user, as in FIG. 3, however, the mitten portion of the article as not enclosing the gloved fingers of the user.

Referring to FIGS. 4–7, these figures show elevational views of the mitten attachment 30 of the present invention, as seen from the backside of the hand of the user, i.e., the side of the user's hand opposite the user's palm. FIG. 4 shows the mitten portion 36 of the invention as resting upon the gloved fingers 22 of the user. FIG. 4 is analogous to drawing FIG. 2; the view being from the opposite side of the user's hand.

Figure 5:
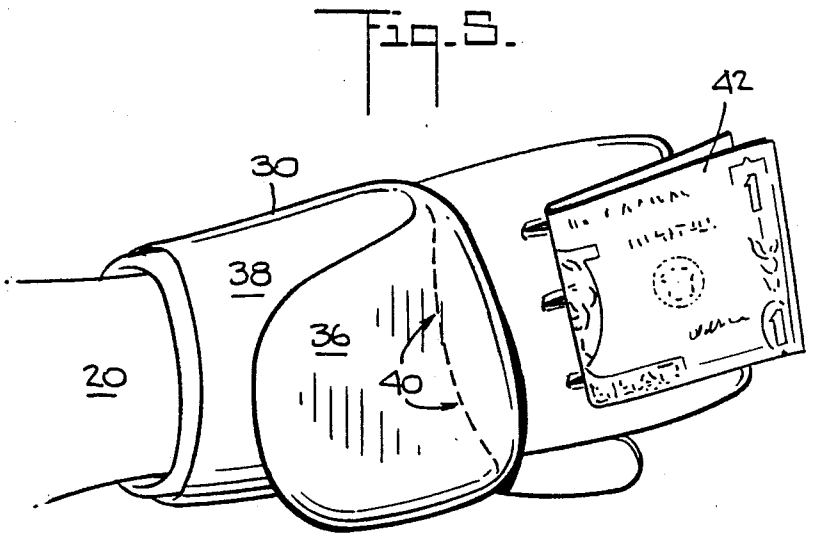
FIG. 5 is an elevational view of the mitten attachment article of the invention secured to the hand of a user with the mitten portion of the invention folded back prior to the placement of money therein.
Figure 7:
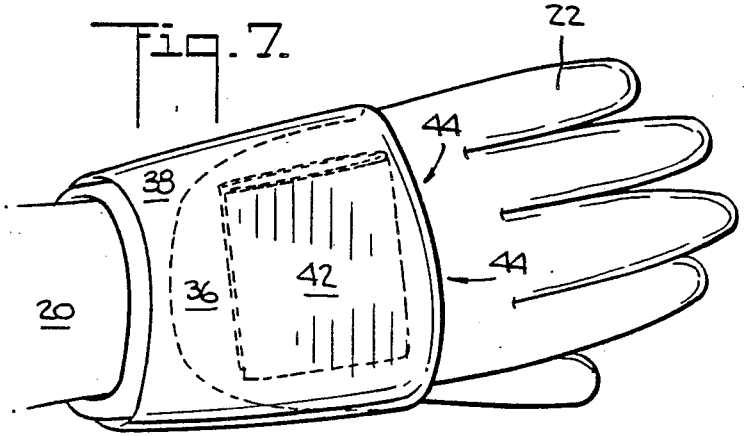
FIG. 7 is an elevational view of the mitten attachment article of the invention secured to the hand of a user with the mitten portion of the article, with the contents thereof as shown in FIG. 6, folded underneath the backside portion of the article.
Figure 6:
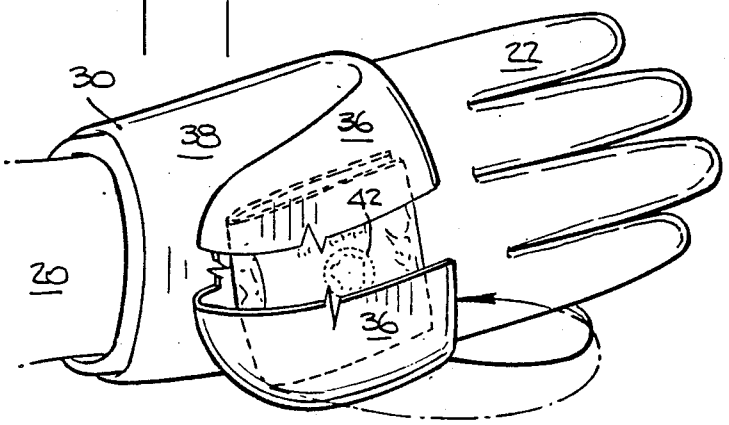
FIG. 6 is an elevational view of the mitten attachment article of the invention secured to the hand of a user with the mitten portion of the article shown as partially broken away to show the contents of the mitten portion.

FIG. 5 shows the mitten portion of FIG. 4 pulled backward toward backside 38. By pulling mitten portion 36 in the fashion shown, mitten portion 36, which may enclose the gloved fingers of the user, as shown in FIGS. 2–3, may alternatively contain items such as money (designated by the reference numeral 42). FIG. 6, with a section of the mitten portion broken away, illustrates the placement of money 42 within mitten portion 36. Finally, after placement of money or other items in the mitten portion of the present invention, it is preferred that mitten portion 36, with its contents 42, be folded toward the gloved fingers 22 of the user and then underneath backside portion 38 of the mitten attachment 30. In this fashion, the contents 42 are securely stowed upon the backside of the user's hand for convenience and safety. The fold (designated by the reference numeral 44) of the mitten portion prevents the contents of the mitten portion, when folded flat beneath the backside portion 38 of the glove attachment from exiting or otherwise unintentionally falling out of the mitten portion of the invention. The end opposite to fold 44 is, of course, sealed closed.

Figure 9:
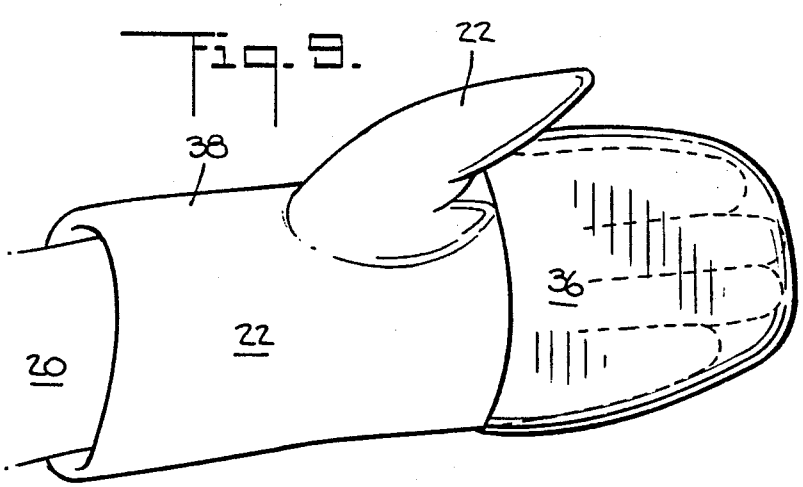
FIG. 9 is an elevational view of the embodiment of the mitten attachment article of FIG. 8 secured to the hand of a user, as viewed from the inner side of the hand of said user, with the gloved fingers of the user enclosed by the mitten portion of the invention.
Figure 8:
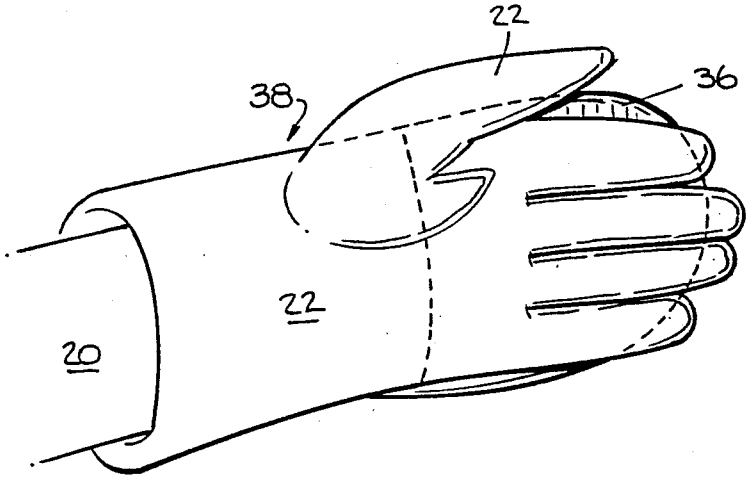
FIG. 8 is an elevational view of another preferred embodiment of the mitten attachment article of the invention secured to the hand of a user, as viewed from the inner side of the hand of said user, with the gloved fingers of the user unenclosed by the mitten portion of the invention.
Figure 10:
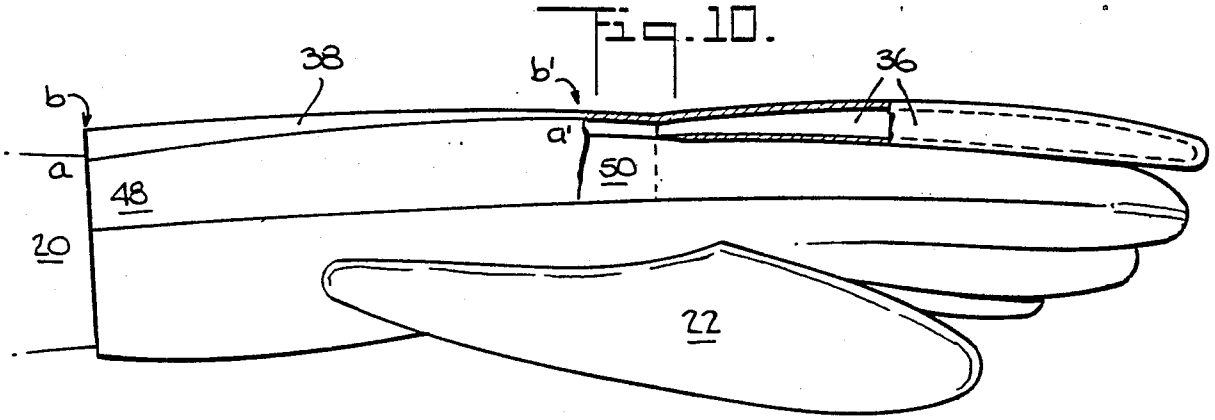
FIG. 10 is a side view of the embodiment of the mitten attachment article of FIG. 8 secured to the hand of a user, as viewed from the inner side of the hand of said user, with the gloved fingers of the user unenclosed by the mitten portion of the invention.

FIGS. 8–10 illustrate an alternatively preferred embodiment of the present invention. In this embodiment, instead of utilizing strap portions to secure the mitten attachment article of the invention to the glove of a user, the mitten attachment of the invention is permanently affixed, or otherwise integral with the user's glove.

One possible embodiment of such a construction is presented in FIGS. 8–10. In this embodiment, backside portion 38 of the inventive article 30 is permanently sewn to the backside of the user's glove along one, two or three edges of the backside portion 38. Preferably, if backside portion 38 is sewn along two or three edges (other than the edge which mitten portion 36 is affixed), a pocket is created between the backside of the user's glove and the backside portion 38 of the mitten attachment of the invention. In this embodiment, mitten portion 36 is of substantially the same construction, and made of the same material, as the embodiment shown in FIGS. 1–7. The interface between the mitten portion 36 of the embodiment of FIGS. 8–10 and the backside portion 38, of this same embodiment should, preferably, not be attached to the backside of the user's glove. In this way, access to the pocket created between the backside portion 38 of the attachment and the backside of the glove is obtained. With such a construction money, keys or other items may be stored in mitten portion 36 and may then be securely stowed away by folding back in the pocket created between the backside portion of the attachment and the backside portion of the glove, in a manner similar to that shown in FIGS. 4–7.

Alternatively, backside portion 38, instead of being completely sewn along its edges to the backside of glove 22, may be attached, or even detachably attached, at its corners (designated a, a′, b, b′ in FIG. 10). By this means of attachment it is possible to place, for example, Velcro or some other material capable of detachable attachment, at corners a, a′ and/or b, b′, so that backside portion 38 may be opened. In this fashion, mitten portion 36 may be supplied more easily with contents wished to be stowed, then folded toward backside portion 38 (in the manner shown in FIG. 7). The corners, e.g., a and a′, or, b and b′ of backside portion 38 may then be secured to the backside of glove 22, with Velcro, for example, with the contents of the mitten portion 36 being safely and securely stowed therein (see, FIG. 7). Alternatively, instead of the corners being provided with Velcro, or a material, Velcro may be placed upon straps (designated by the reference numerals 48 and 50 in FIG. 10) extending from backside portion 38 of the mitten attachment. Such straps are analogous to the corners a, a′, b, b′, described above.

FIGS. 11–17 show an alternative preferred embodiment of the present invention wherein the mitten attachment of the present invention shown and described above further includes a thumb attachment portion 50 for enclosing, at the option of the wearer, the gloved thumb of the wearer. Thumb attachment portion 50 is preferably made integral with the mitten attachment 30 of the present invention and preferably extends from the backside portion 38 of the mitten attachment 30 of the invention.

Figure 11:
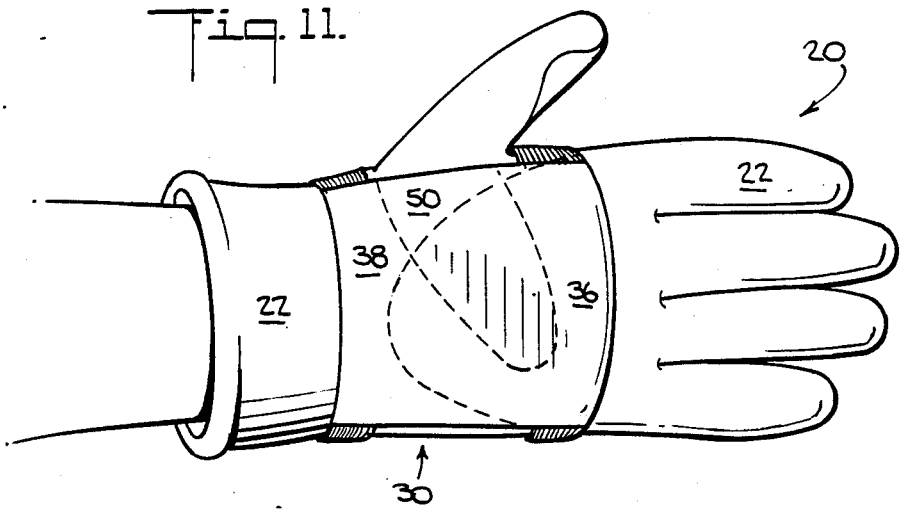
FIG. 11 is an elevational view of the mitten attachment of the present invention on the hand of a wearer, the embodiment shown as further including a thumb attachment portion, with the thumb attachment portion and mitten portion being folded underneath the backside portion of the article.

In particular, FIG. 11 is an elevational view of the gloved hand 22 of a user of the present invention, as seen from the backside of the user's hand, wherein mitten attachment 30 is secured to the gloved hand of the user while mitten portion 36, which may be used for the stowage of common pocket items, and thumb attachment portion 50, are stored, preferably flat, underneath backside portion 38 of mitten attachment 30.

Figure 12:
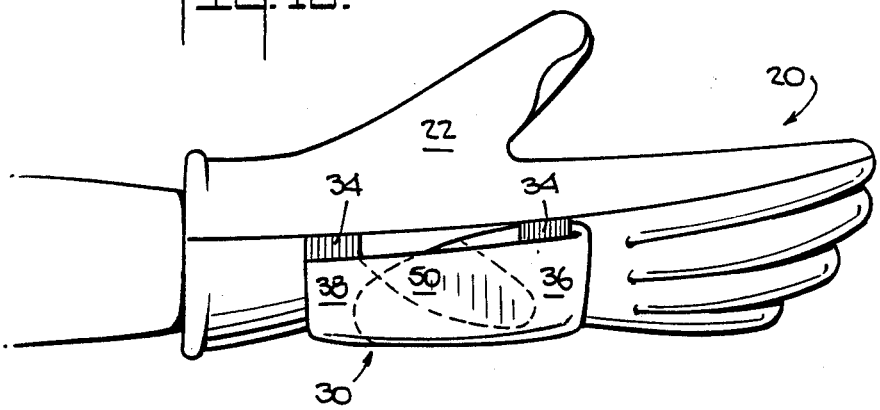
FIG. 12 is a side view of the mitten attachment embodiment of FIG. 11 of the present invention, which includes a thumb attachment portion, shown as being secured to the gloved hand of a wearer.

FIG. 12 presents a substantially side angle view of the features of the embodiment of the invention shown in FIG. 11 and described above.

FIG. 13 presents a substantially side angle view of the mitten attachment 30 of the embodiment shown in FIG. 11, which includes thumb attachment portion 50. In FIG. 13, mitten portion 36 and thumb attachment portion 50 are shown following their removal from beneath backside portion 38 of the mitten attachment 30 of the present invention. It should be noted that the wearer of the mitten attachment has the option of removing from beneath backside portion 38, either mitten portion 36 and/or thumb attachment portion 50. In other words, either the mitten portion or the thumb attachment portion of the present invention may be used independently of the other portion. For this reason, such is considered the most preferred embodiment and best mode of the present invention.

FIG. 14 presents a side view of the mitten attachment 30 of the present invention which includes thumb attachment portion 50, while FIG. 15 presents an elevational view of the same as seen from the backside of the hand of a wearer and FIG. 16 illustrates an elevational view of the same as seen from the palm side of the hand of the wearer. In FIGS. 14–16, thumb portion 50 is shown covering and enclosing the gloved thumb of the wearer, while mitten portion 36 of the invention is shown covering and enclosing the gloved four fingers of the wearer. From this view, it may be appreciated that the construction of the mitten attachment 30 of the invention, incorporating thumb portion 50, is analogous to the embodiments shown in FIGS. 1–10 above. Straps 34 are a preferred means for removably securing the mitten attachment of the invention to glove 22 of the wearer. It, of course, may be readily seen that the mitten attachment embodiment illustrated in FIGS. 11–16 may also be made to be permanently affixed to glove 22.

Figure 17:
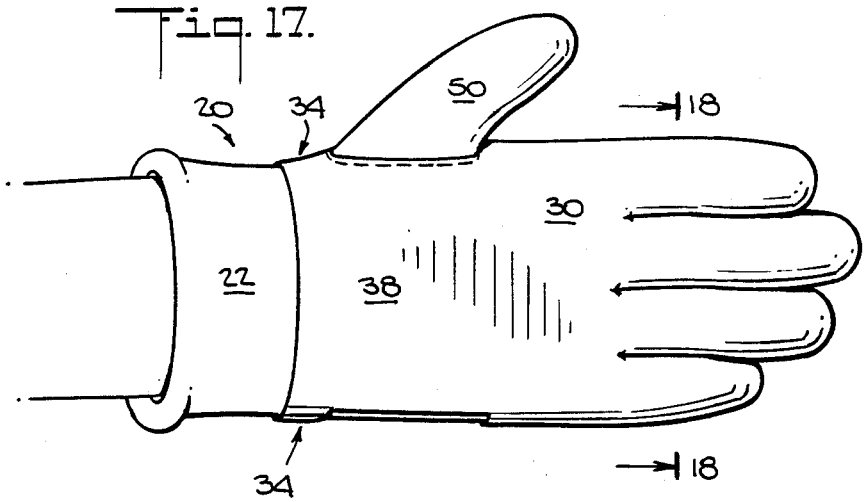
FIG. 17 is an elevational view of the backside of the hand of a wearer of the glove attachment of the present invention wherein, in the embodiment shown, the gloved thumb and each finger are enclosed in a separate portion of the attachment.
Figure 18:
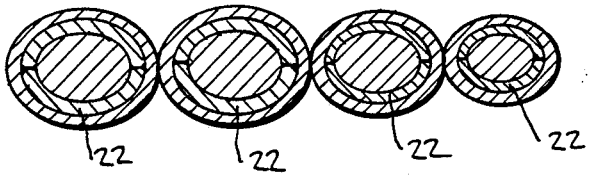
FIG. 18 is a cross-sectional view taken along the 18—18 line of the embodiment of FIG. 17.
Figure 19:
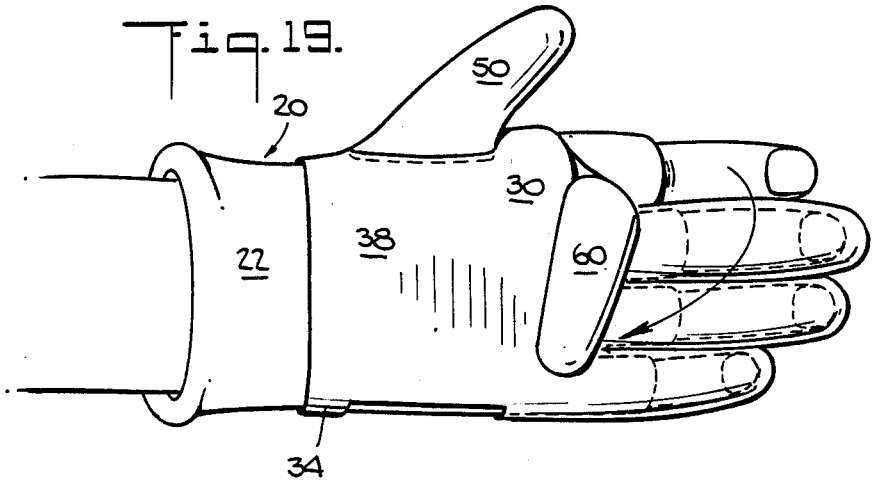
FIG. 19 is an elevational view of the embodiment of FIG. 18 of the glove attachment piece of the present invention in combination with a fingerless glove as worn by a user of the present invention, one finger portion of the glove attachment being shown as being removed from an enclosure of one finger of the user.

FIGS. 17–19 illustrate a further embodiment of the present invention wherein, instead of having a mitten portion 36, the glove attachment 30 of the present invention has individual finger portions for each of the user's fingers. Such portions would cover and enclose the gloved hand of the user and may or may not also include a thumb attachment portion 50 as shown and described above in reference to FIGS. 11–16.

The present invention, whether used with or without a mitten portion 36 (as opposed to a multi-fingered portion) and/or with or without a thumb attachment portion 50, may be used in combination with the fingerless glove as well. Specifically, FIG. 19 illustrates the embodiment of FIG. 18 of the glove attachment piece 30 of the present invention in combination with a fingerless glove 22 as worn by a user of the present invention, wherein one finger portion 60 of the glove attachment being shown is shown as being removed from the enclosure of one finger of the user.

FIGS. 20–23 show yet a further, preferred embodiment of the present invention wherein in FIGS. 20 and 21, instead of folding a thumb attachment portion 50 underneath backside portion 38 of the mitten attachment of the invention, thumb attachment portion 50 is folded backward to and against the outer side of backside portion 38. Thereafter, instead of folding underneath, mitten portion 36, this portion is also folded backward against the outer side of backside portion 38 so that it overlaps and covers thumb attachment portion 50. In this embodiment, mitten attachment portion 36 and backside portion 38 are each provided with complementary means for securement 70*a* and 70*b* of the mitten portion 36 to backside portion 38.

FIG. 21 is an elevational view showing the embodiment of FIG. 20, following the folding back of thumb portion 50 and the folding back and securement of mitten portion 36.

FIGS. 22 and 23 show a modified embodiment of the embodiment presented in FIGS. 20 and 21. In FIGS. 22 and 23, mitten portion 36 and thumb attachment portion 50 are shown as being directly attached directly to the backside of the glove 22 of the wearer, i.e., without the structure involving mitten backside portion 38. As shown in FIG. 22, thumb portion 50 is to, first, be folded backward directly against the backside 22 of the glove of the wearer. Thereafter, mitten portion 36 is folded backward directly against the backside of glove 22 (thereby overlapping thumb portion 50, previously folded backward) and subsequently secured to the backside of glove 22 by securing means, such as Velcro, preferably, or other complementary means for securement. FIG. 23 is an elevational view showing the embodiment of FIG. 22, following the folding back of thumb portion 50 and the folding back and securement of mitten portion 36.

Figure 24:
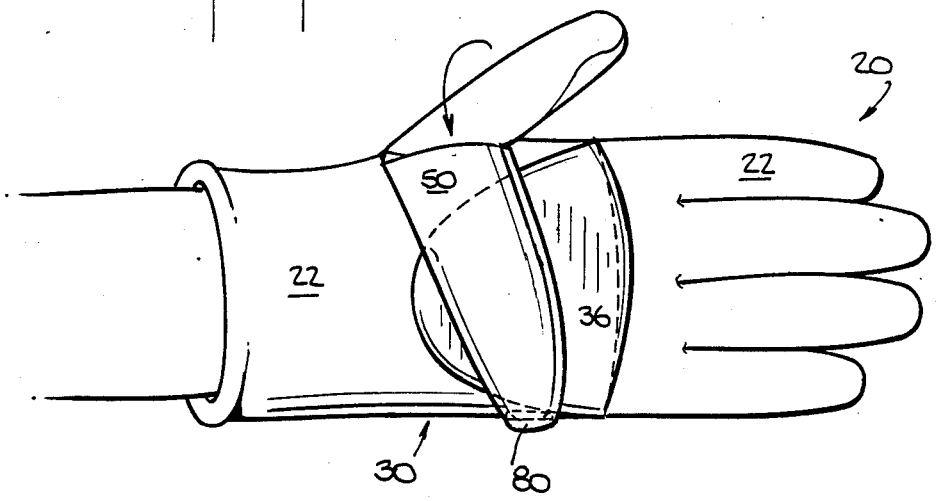
FIG. 24 is an elevational view wherein the mitten portion of the invention is initially folded backward and the thumb portion is then to be folded over the already folded-backward mitten portion and secured in such crossed-over position to hold in place the mitten portion, wherein the mitten and thumb portions are directly attached to the glove of the wearer; and, FIG. 25 is an elevational view of the embodiment of FIG. 24 of the present invention, except that the thumb and mitten portions of the invention are secured by the mitten attachment/backside portion shown in FIGS. 20 and 21, rather than being directly attached to the glove of the wearer.

FIG. 24 is an elevational view of yet a further embodiment of the present invention wherein mitten portion 36 of the invention may, initially, be folded backward. Thereafter, thumb portion 50, which is preferably made of a flexible, stretchable material, may then be folded over the already folded-backward mitten portion and secured in such crossed-over position to hold in place the mitten portion. The thumb portion, in such an embodiment would have to be provided with means for securement (80) of the glove. Such means for securement may include a Velcro attachment, a clip, a buckle attachment, etc. A Velcro attachment would be preferable, however.

Figure 25:
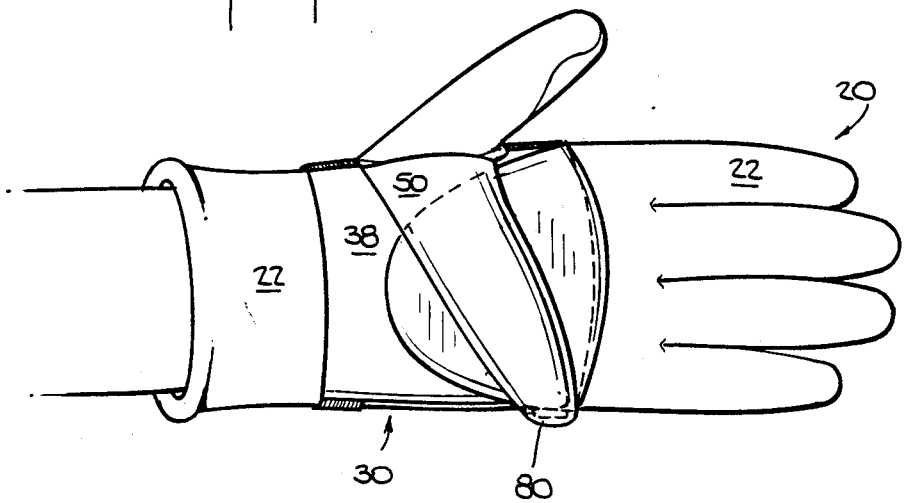

In FIG. 24, the mitten portion (36) and the thumb portion (50) are directly attached to glove 22 of the wearer. In FIG. 25, the embodiment of FIG. 24 is presented wherein mitten portion 36 and thumb portion 50 are secured by the mitten attachment/backside portion shown in FIGS. 20 and 21, and described heretofore in the present disclosure.

Additional variations and modifications of the present invention, it should be recognized, are, of course, possible. For example, in the embodiment wherein two or more corners of the backside portion of the mitten attachment are secured to the backside portion of the glove Velcro or a similar material may be placed at numerous portions other than at the corners. Alternatively, only one strap, or more than two straps (two straps being shown in FIG. 10), may be supplied with Velcro to secure the backside portion of the invention to the glove of the user following placement of the contents intended for stowage within the mitten portion of the invention.

In a further embodiment of the present invention, it is possible to have a fingerless glove with both a mitten attachment portion made out of, for example, neoprene, as described above, and further including a fingered portion set of enclosures, as illustrated, for example, in FIG. 19. The wearer of the glove would have both the fingered set of enclosures (made out of, for example, a layer of cotton) and the mitten portion and may utilize either or both, or neither, or such features at any given time. Such embodiment if, of course, encompassed within the scope of the present invention and within the literal language of the following set of claims.

While only several embodiments of the present invention have been shown and described, it will be obvious to those skilled in the art that many modifications may be made to the invention without departing from the spirit and scope thereof.

What is claimed is:

1. A mitten attachment article for a glove, the glove being worn on the hand of a wearer, said mitten attachment article being intended for use on the glove of the hand of the wearer, said mitten attachment article comprising:

a backside portion which is to be in communication with the backside of the glove;

means for securing said backside portion of said mitten attachment article to the glove of the wearer;

a mitten portion attached to said backside portion of said mitten attachment article, said mitten portion being capable of enclosing the gloved fingers of the wearer of the glove and said mitten portion also being capable of containing items for stowage, said mitten portion being capable of being folded underneath said backside portion for secure stowage of said items; and, a thumb attachment portion attached to said backside portion of said mitten attachment article, said thumb attachment portion being capable of enclosing a gloved thumb of the wearer of the glove and said thumb attachment portion being capable of being folded underneath said backside portion.

2. The mitten attachment article according to claim 1, wherein said mitten attachment article is made of a flexible material.

3. The mitten attachment article according to claim 2, wherein said mitten attachment article is made of neoprene.

4. The mitten attachment article according to claim 1, wherein said backside portion, said means for securing and said mitten portion are formed as an integral construction.

5. The mitten attachment article according to claim 1, wherein said means for securing said backside portion to said glove are means for detachable attachment.

6. The mitten attachment article according to claim 5, wherein said means for securing is, at least, one encircling strap which is attached to opposite edges of said backside portion of said mitten attachment article, said encircling strap being capable of encircling the gloved hand of the wearer to secure said article onto the gloved hand of the wearer.

7. The mitten attachment article according to claim 1, wherein said means for securing said backside portion of said mitten attachment article to said glove includes means for the detachable attachment of at least a portion of said backside portion of said mitten article.

8. The mitten attachment article according to claim 7, wherein said means of detachable attachment of at least a portion of said backside portion of said mitten article to said glove is carried out with a complementary hook-and-loop material on said backside portion and the glove.

9. The mitten attachment article according to claim 7, wherein said means for detachable attachment of at least a portion of said backside portion of said mitten article to said glove is by means of at least one strap extending from said backside portion of said mitten article, said strap and said glove having complementary hook-and-loop material for detachable attachment.

10. The mitten attachment article according to claim 1, wherein said means for securing said backside portion of said mitten attachment article is by a permanent attachment of said backside portion to said backside of the glove.

11. The mitten attachment article according to claim 10, wherein said permanent attachment of said backside portion to said backside of the glove forms a pocket between said backside portion of said mitten attachment article and the backside of the glove of the wearer whereby the wearer is capable of placing items within said mitten portion of said article and is capable of folding said mitten portion into said pocket formed between said portion of said mitten attachment article and the backside of the glove of the wearer.

12. A glove attachment article for a glove, the glove being worn on the hand of a wearer, said glove attachment article being intended for use on the glove of the hand of the wearer, said glove attachment article comprising:

a backside portion which is to be in communication with the backside of the glove;

means for securing said backside portion of said glove attachment article to the glove of the wearer; and, four fingered portions attached to said backside portion of said glove attachment article, said four fingered portions each being capable of enclosing a gloved finger of the wearer of the glove, said four figured portions being capable of being folded underneath said backside portion for secure stowage of said items.

13. The glove attachment article according to claim 12, wherein said glove attachment article is made of neoprene.

14. The glove attachment article according to claim 12, wherein said backside portion, said means for securing and said four fingered portions are formed as an integral construction.

15. The glove attachment article according to claim 12, wherein said means for securing said backside portion to said glove are means for detachable attachment.

16. The glove attachment article according to claim 15, wherein said means for securing is, at least, one strap which is attached to opposite edges of said backside portion of said glove attachment article, to secure said article onto the gloved hand of the wearer.

17. The glove attachment article according to claim 12, wherein said means for securing said backside portion of said glove attachment article to said glove includes means for the detachable attachment of at least a portion of said backside portion of said glove article.

18. The glove attachment article according to claim 12, wherein said means for securing said backside portion of said glove attachment article is by a permanent attachment of said backside portion to said backside of the glove.

19. A glove attachment article for a glove, the glove being worn on the hand of a wearer, said glove attachment article being intended for use on the glove of the hand of the wearer, said glove attachment article comprising:

a backside portion which is to be in communication with the backside of the glove;

means for securing said backside portion of said mitten attachment article to the glove of the wearer; and, four fingered portions attached to said backside portion of said glove attachment article, said four fingered portions each being capable of enclosing gloved finger of the wearer of the glove, said four figured portions being capable of being folded underneath said backside portion for secure stowage of said items; and, a thumb attachment portion attached to said backside portion of said glove attachment article, said thumb attachment portion being capable of enclosing a gloved thumb of the wearer of the glove and said thumb attachment portion being folded underneath said backside portion.

20. The glove attachment article according to claim 19, wherein said glove attachment article is made of neoprene.

21. The glove attachment article according to claim 19, wherein said backside portion, said means for securing and said four fingered portions are formed as an integral construction.

22. The glove attachment article according to claim 19, wherein said means for securing said backside portion to said glove are means for detachable attachment.

23. The glove attachment article according to claim 22, wherein said means for securing is, at least, one encircling strap which is attached to opposite edges of said backside portion of said mitten attachment article, said encircling strap being capable of encircling the gloved hand of the wearer to secure said article onto the gloved hand of the wearer.

24. The glove attachment article according to claim 19, wherein said means for securing said backside portion of said glove attachment article to said glove includes means for the detachable attachment of at least a portion of said backside portion of said glove article.

25. The glove attachment article according to claim 19, wherein said means for securing said backside portion of said glove attachment article is by a permanent attachment of said backside portion to said backside of the glove.

26. A mitten attachment article for a glove, the glove being worn on the hand of a wearer, said mitten attachment article being intended for use on the glove of the hand of the wearer, said mitten attachment article comprising:

a backside portion which is to be in communication with the backside of the glove;

means for securing said backside portion of said mitten attachment article to the glove of the wearer;

a thumb attachment portion attached to said backside portion of said mitten attachment article, said thumb attachment portion being capable of enclosing a gloved thumb of the wearer of the glove and said thumb attachment portion being capable of being folded backward against said backside portion; and, a mitten portion attached to said backside portion of said mitten attachment article, said mitten portion being capable of enclosing the gloved fingers of the wearer of the glove, said mitten portion being capable of being folded backward against an outer side of said backside portion, said mitten portion further including means for securing said mitten portion to said outer side of said mitten portion.

27. The mitten attachment article according to claim 26, wherein said mitten attachment article is made of a flexible material.

28. The mitten attachment article according to claim 26, wherein said means for securing said backside portion to said glove are means for detachable attachment.

29. The mitten attachment article according to claim 26, wherein said means for securing said backside portion of said mitten attachment article is by a permanent attachment of said backside portion to said backside of the glove.

30. The mitten attachment article according to claim 26, wherein means for securing said mitten portion to said outer side of said backside portion is by complementary mating attachment means.

31. The mitten attachment article according to claim 30, wherein means for securing said mitten portion to said outer side of said backside portion is by a hook-and-loop fastening attachment means.

32. A mitten attachment article for a glove, the glove being worn on the hand of a wearer, said mitten attachment article being intended for use on the glove of the hand of the wearer, said mitten attachment article comprising:

a thumb attachment portion directly attached to a backside of said glove, said thumb attachment portion being capable of enclosing a gloved thumb of the wearer of the glove and said thumb attachment portion being capable of being folded backward against the backside of said glove; and, a mitten portion directly attached to the backside of said glove, said mitten portion being capable of enclosing the gloved fingers of the wearer of the glove, said mitten portion being capable of being folded backward against the backside of said glove, said mitten portion further including means for securing said mitten portion to the backside of said glove so as to secure said thumb portion between said mitten portion and the backside of said glove.

33. The mitten attachment article according to claim 32, wherein said mitten attachment article is made of a flexible material.

34. The mitten attachment article according to claim 32, wherein means for securing said mitten portion to the backside of said glove is by complementary mating attachment means.

35. The mitten attachment article according to claim 34, wherein means for securing said mitten portion to the backside of said glove is by a hook-and-loop fastening attachment means.

36. A mitten attachment article for a glove, the glove being worn on the hand of a wearer, said mitten attachment article being intended for use on the glove of the hand of the wearer, said mitten attachment article comprising:

a backside portion which is to be in communication with the backside of the glove;

means for securing said backside portion of said mitten attachment article to the glove of the wearer;

a mitten portion attached to said backside portion of said mitten attachment article, said mitten portion being capable of enclosing gloved fingers of the wearer of the glove and said mitten portion being capable of being folded backward against an outer side of said backside portion; and, a thumb portion attached to said backside portion of said mitten attachment article, said thumb portion being capable of enclosing a gloved thumb of the wearer of the glove, said thumb portion being capable of being folded backward against the outer side of said backside portion, said thumb portion further including means for securing said thumb portion to said mitten attachment article whereby said thumb portion acts as a means for strapping in place said initially folded-back mitten portion.

37. The mitten attachment article according to claim 36, wherein said mitten attachment article is made of a flexible material.

38. The mitten attachment article according to claim 36, wherein said means for securing said backside portion to said glove are means for detachable attachment.

39. The mitten attachment article according to claim 36, wherein said means for securing said backside portion of said mitten attachment article is by a permanent attachment of said backside portion to said backside of the glove.

40. The mitten attachment article according to claim 36, wherein means for securing said thumb portion is by complementary mating attachment means.

41. The mitten attachment article according to claim 40, wherein means for securing said thumb portion is by a hook-and-loop fastening attachment means.

42. A mitten attachment article for a glove, the glove being worn on the hand of a wearer, said mitten attachment article being intended for use on the glove of the hand of the wearer, said mitten attachment article comprising:

a mitten portion directly attached to a backside of said glove, said mitten portion being capable of enclosing gloved fingers of the wearer of the glove and said mitten portion being capable of being folded backward against an outer side of said backside of said glove; and, a thumb portion directly attached to said backside of said glove, said thumb portion being capable of enclosing a gloved thumb of the wearer of the glove, said thumb portion being capable of being folded backward against the outer side of said backside of said glove, said thumb portion further including means for securing said thumb portion to said glove whereby said thumb portion acts as a means for strapping in place said initially folded-back mitten portion.

43. The mitten attachment article according to claim 42, wherein said mitten attachment article is made of a flexible material.

44. The mitten attachment article according to claim 42, wherein means for securing said thumb portion to said glove is by complementary mating attachment means.

45. The mitten attachment article according to claim 44, wherein means for securing said thumb portion to said glove is by a hook-and-loop fastening attachment means.

* * * * *